United States Patent [19]

Gannaway

[11] Patent Number: 4,844,705

[45] Date of Patent: Jul. 4, 1989

[54] SUCTION LINE ADAPTOR AND FILTER FOR A HERMETIC COMPRESSOR

[75] Inventor: Edwin L. Gannaway, Adrian, Mich.

[73] Assignee: Tecumseh Products Company, Tecumseh, Mich.

[21] Appl. No.: 147,816

[22] Filed: Jan. 25, 1988

[51] Int. Cl.[4] ..... F04B 35/04; F04B 39/00

[52] U.S. Cl. ..... 417/313; 417/419; 417/902; 285/354

[58] Field of Search ..... 417/902, 312, 410, 366, 417/313, 419; 285/138, 349, 354

[56] References Cited

U.S. PATENT DOCUMENTS

| | | | |
|---|---|---|---|
| 2,243,466 | 5/1941 | Kucher | 417/902 X |
| 2,278,479 | 4/1942 | Parker | 285/354 X |
| 2,353,347 | 7/1944 | McCormack | 62/193 |
| 2,439,241 | 4/1948 | Curtis et al. | 418/149 |
| 2,477,677 | 8/1949 | Woodling | 285/354 X |
| 2,517,367 | 8/1950 | Winkler | 417/360 |
| 2,628,016 | 2/1953 | Higham | 417/902 X |
| 2,705,651 | 4/1955 | Myers | 285/354 X |
| 3,008,629 | 11/1961 | Gerteis | 417/902 X |
| 3,031,861 | 5/1962 | McCormack | 62/186.3 |
| 3,311,292 | 3/1967 | Connor | 417/902 X |
| 3,767,334 | 10/1973 | Rinehart | 417/902 X |
| 3,870,440 | 3/1975 | Zuercher, Jr. | 418/248 |
| 4,160,625 | 7/1979 | Dyhr et al. | 417/363 |
| 4,240,774 | 12/1980 | Ladusaw | 418/248 |
| 4,242,056 | 12/1980 | Dyhr et al. | 417/363 |
| 4,334,835 | 6/1982 | Dyhr et al. | 417/363 |
| 4,606,706 | 8/1986 | Utter | 417/313 |
| 4,639,198 | 1/1987 | Gannaway | 417/410 |

FOREIGN PATENT DOCUMENTS

| | | | |
|---|---|---|---|
| 0129286 | 8/1982 | Japan | 417/902 |

*Primary Examiner*—Carlton R. Croyle
*Assistant Examiner*—Leonard P. Walnoha
*Attorney, Agent, or Firm*—Albert L. Jeffers; David L. Ahlersmeyer

[57] ABSTRACT

A compressor assembly is disclosed including a compressor mechanism mounted within a hermetically sealed housing. The compressor mechanism includes a crankcase having a suction inlet opening providing communication into a suction cavity within the crankcase. A suction line adaptor is provided for attaching to a suction line of a refrigeration system to introduce suction gas into the suction inlet opening. The suction line adaptor includes a fitting mounted to the sidewall of the housing. The fitting defines a bore communicating through the housing wall. A radially outwardly extending annular groove is provided in the sidewall of the bore. A section of tubing having a washer-shaped flange at one end thereof extends between the fitting and the suction inlet opening. The tube section end opposite the flange is sealingly received at a variable depth within the suction inlet opening using an O-ring seal. The other end of the tube section is received within the bore with the flange received within the groove. The tube section is selectively positionable within the bore to compensate for misalignment of the suction inlet opening and the fitting bore.

15 Claims, 3 Drawing Sheets

SUCTION LINE ADAPTOR AND FILTER FOR A HERMETIC COMPRESSOR

BACKGROUND OF THE INVENTION

The present invention relates generally to a hermetic compressor assembly and, more particularly, to a direct suction compressor assembly having a crankcase mounted within a sealed housing, wherein suction gas is delivered directly to the crankcase from a suction line outside the housing by means of a suction line adaptor.

In general, prior art of hermetic compressor assemblies comprise a hermetically sealed housing having a compressor mechanism mounted therein. The compressor mechanism may include a crankcase or a cylinder block defining a compression chamber therein in which gaseous refrigerant is compressed and subsequently discharged. Typically, and especially in the case of a compressor assembly having a pressurized housing, suction gas returning from a refrigeration system is provided to the compression chamber by means of a conduit extending from outside the housing to the compression chamber within the crankcase. This configuration is commonly referred to as a direct suction compressor assembly. In such a compressor assembly, it is known to introduce suction tubing through the housing and into a suction inlet opening in the crankcase or cylinder block that is in communication with the compression chamber. The portion of the tubing external of the housing may comprise part of a suction accumulator or may constitute a fitting to which a suction line of a refrigeration system may be attached.

In the aforementioned compressor assembly wherein a suction tube leads from an inlet aperture in the crankcase through a hole in the housing, misalignment of the crankcase with respect to the housing may cause the suction tubing to be overstressed when assembled. More specifically, dimension tolerances during machining of component parts of the compressor assembly, particularly the location of apertures and opening through which the suction tube extends, may cause difficulty in assembling the compressor and produce unwanted stress on the suction tubing once the compressor is assembled. During operation of the compressor, stress on the suction tubing in contact with the housing produces unwanted noise.

The alignment problems discussed herein have been addressed by several prior art devices. For instance, a suction line adaptor is known which comprises a pair of L-fittings respectively attached to the housing and the crankcase at axially spaced locations thereon, and a connecting tube inside the housing between the pair of L-fittings axially perpendicular to and disposed between the housing and the crankcase. The connecting pipe is capable of moving relative to one or both of the L-fittings to compensate for variations in radial and axial spacing between the housing and the crankcase. A problem with such a suction tube adaptor is that space is required between the crankcase and the housing sidewall within the housing.

Another common prior art approach to compensating for radial spacing between the housing and the inlet aperture in the compressor crankcase is the provision of an O-ring seal within the inlet opening to allow a suction tube end to variably penetrate into the aperture. Typically in this approach, an adaptor at the housing aperture is welded to the housing and brazed to the tubing.

Another prior art suction tube adaptor directed to compensating for spacing variations between the housing and the compressor crankcase comprises a tube entering radially inwardly from the housing sidewall having a slotted conical flange at the end thereof to abut against the crankcase in the general area of the suction inlet aperture. The divergent end of the conical flange has a diameter greater than the suction inlet aperture, thereby permitting alignment variations.

It is known in the prior art to provide filtering means within a refrigeration system, and more particularly in a compressor assembly, in order to filter out impurities and liquid gas refrigerant fed to the compressor assembly through the suction line. Known filtering means are overly complicated and often involve a centrifuging action. Also, suction accumulators often perform this filtering function by providing a screen member in the accumulator housing or on the end of a suction tube entering the suction accumulator. Such a screen member is not easily removed from the suction accumulator assembly for cleaning.

With respect to suction line adaptors for use in an indirect suction hermetically sealed compressor assembly, i.e., where the suction gas enters into the interior space of the housing, a suction line adaptor device is known which is attached to the housing as by welding. This adaptor comprises two pieces, one of which is welded to the housing at the location of the aperture therethrough, and the other being a coupling member attachable to a refrigeration system suction line as by brazing or the like. The coupling member with suction line attached thereto is then screwed onto the fitting welded to the housing for sealing engagement therewith. A nut threadedly engages each of the two components and brings them forcibly together at a surface to surface juncture having an O-ring sea seated therebetween.

SUMMARY OF THE INVENTION

The present invention overcomes the disadvantages of the above-described prior art suction line adaptors by providing an improved adaptor for a direct suction hermetic compressor assembly wherein axial and radial spacing variations between an aperture in the housing and an inlet opening in the compressor crankcase may be compensated for.

In general, the invention provides a suction line adaptor for a compressor assembly including a compressor mechanism housed within a hermetically sealed housing. The suction line adaptor is mounted at one end thereof to the sidewall of the housing and is received at the other end thereof into a suction inlet opening in the compressor mechanism. The suction adaptor includes a tube portion extending radially outwardly from the compressor mechanism concentric with the axis of the suction inlet opening. The tube is permitted to be selectively positioned along a set of parallel axes.

More specifically, the invention, provides in one form thereof, a suction line adaptor for a hermetic compressor assembly wherein a fitting is mounted in the sidewall of the housing defining a bore generally axially aligned with a suction inlet opening in the crankcase of a compressor mechanism housed within the housing. A tube insert is sealingly received at one end thereof within the suction inlet opening and extends radially outwardly into the bore defined by the fitting. The tube insert is capable of being positioned at various axially parallel positions within the bore, thereby allowing for variations in positioning of the compressor mechanism with respect to the housing.

An advantage of the suction line adaptor of the present invention is that compensation for tolerances in housing machining and in crankcase machining and mounting is provided.

Another advantage of the suction line adaptor of the present invention is that thinner suction line tubing for connecting between the compressor assembly housing and the crankcase can be used due to the elimination of stresses thereon.

A still further advantage of the suction line adaptor in accordance with the present invention is that very little, if any, space is required between the housing sidewall and the crankcase.

A still further advantage of the suction line adaptor according to the present invention is that an easily removable conical screen filter is provided in combination with a suction line fitting.

The compressor assembly of the present invention, in one form thereof, provides a hermetically sealed housing having a sidewall, and means supported within the housing for compressing gas refrigerant. The compressing means includes a compressor mechanism having a crankcase, wherein the crankcase has a suction cavity disposed therein. The crankcase further includes a suction inlet opening providing communication between the suction cavity and the outside of the crankcase. Furthermore, a suction fitting is mounted in the sidewall, the fitting defining a substantially cylindrical fitting bore extending therethrough along a bore axis substantially perpendicular to the sidewall. A suction tube insert is provided having a first axial end received within the fitting bore and having a second end sealingly received within the suction inlet opening. The present invention in this form further provides adjustable means for retaining the suction tube insert within the fitting bore such that the axis of the first end is substantially parallel to and selectively spaced relative to the bore axis.

There is further provided, in one form of the present invention, a compressor assembly having a compressor mechanism supported within a hermetically sealed housing having a sidewall. The compressor mechanism includes a crankcase including therein a suction cavity and a suction inlet opening providing communication between the cavity and the outside of the crankcase. The suction inlet opening extends radially outwardly from the cavity along a radial axis substantially perpendicular to the sidewall. According to this form of the present invention, a suction fitting assembly providing communication between the suction inlet opening and the outside of the housing includes a fitting member mounted to the sidewall and including a bore extending therethrough generally along the radial axis. The fitting member includes an annular groove in communication with the bore and extending radially outwardly therefrom with respect to the radial axis. The suction fitting assembly further includes an elongated tubular insert member having a diameter smaller than the diameter of the bore. The insert member includes a washer-shaped flange circumferentially attached to the outside wall of the tubular insert member and extending radially outwardly therefrom. The outermost diameter of said flange is less than the outermost diameter of the annular groove. Also, one end of the insert member is slidably received within the suction inlet opening, and the other end is received within the bore. The flange is received within the annular groove, whereby the tubular insert member is selectively positioned within the bore to compensate for axial misalignment between the suction inlet opening and the bore.

The compressor assembly of the present invention further provides, in one form thereof, a hermetically sealed housing including a vertical cylindrical sidewall. A compressor mechanism for compressing gas refrigerant is also provided including a crankcase having a mounting flange portion. The crankcase includes therein a suction cavity and a suction inlet opening to provide communication between the cavity and the outside of the crankcase. The suction inlet opening extends radially outwardly from the cavity along a radial axis substantially perpendicular to the sidewall. Means associated with the sidewall are provided for axially supporting the compressor mechanism. The supporting means includes an annular ledge on which the flange portion rests. Also, means for preventing rotational movement of the crankcase about the vertical axis of the housing are provided. The preventing means includes a pin member received within a hole in the crankcase and extending through an aperture in the sidewall. The pin member is welded to the housing at the location of the aperture. Furthermore, a suction fitting is mounted in the sidewall. The fitting includes a substantially cylindrical fitting bore extending therethrough along a bore axis substantially perpendicular to the sidewall. A suction tube insert has a first axial end received within the fitting bore and a second end slidably sealingly received within the suction inlet opening. The invention in this form further provides adjustable means for retaining the suction tube insert within the fitting bore with the axis of the first end being substantially parallel to and selectively spaced relative to the bore axis.

DESCRIPTION OF THE PREFERRED EMBODIMENT

Figure 1:
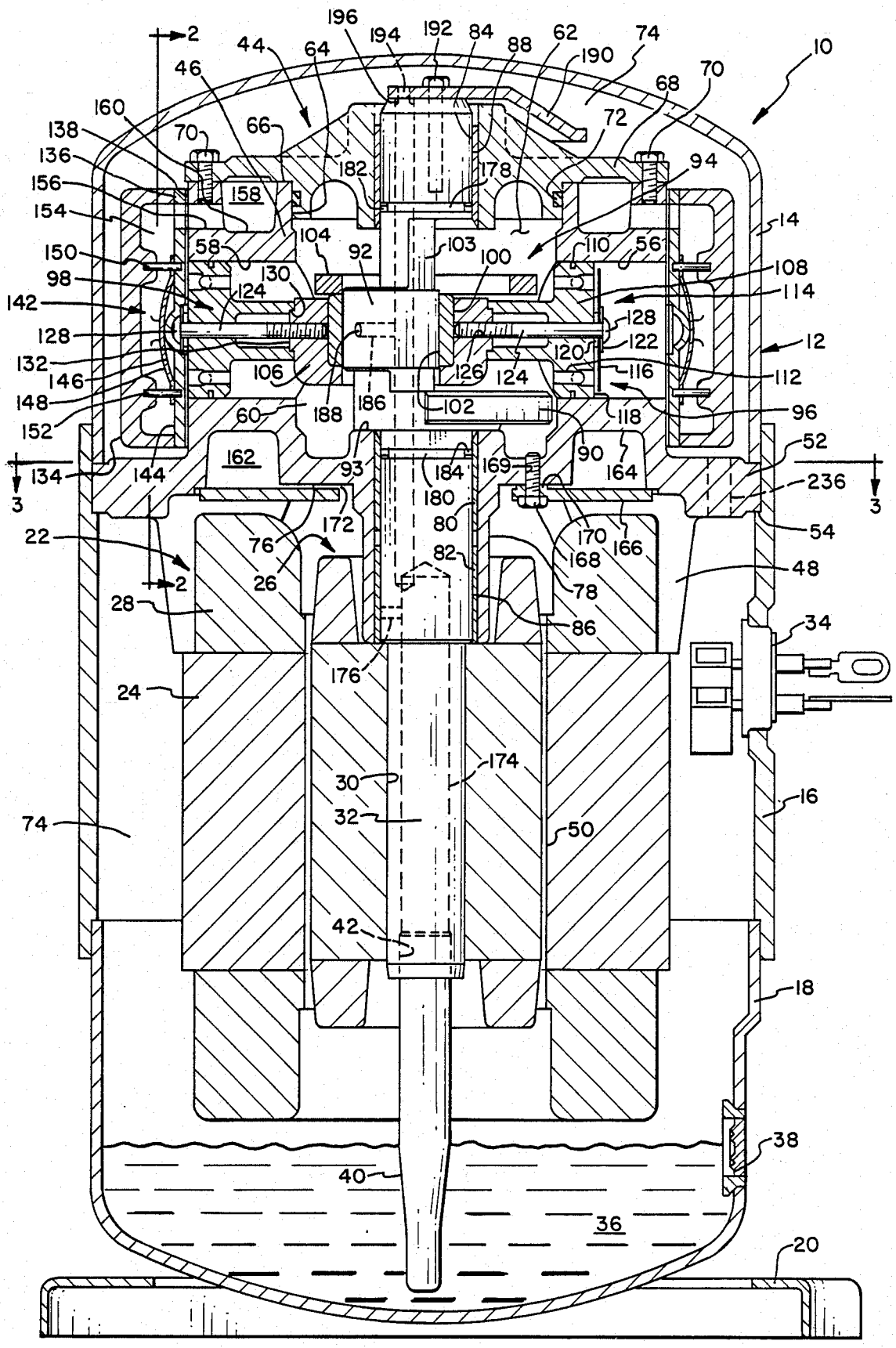
FIG. 1 is a side sectional view of a compressor of the type to which the present invention pertains.

In an exemplary embodiment of the invention as shown in the drawings, and in particular by referring to FIG. 1, a compressor assembly 10 is shown having a housing generally designated at 12. The housing has a top portion 14, a central portion 16, and a bottom portion 18. The three housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in central portion 16 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment of FIG. 1, is a compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. A bore 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an O-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

A sleeve bearing, as referred to herein, is defined as a generally cylindrical bearing surrounding and providing radial support to a cylindrical portion of a crankshaft, as opposed to a thrust bearing which provides axial support for the weight of the crankshaft and associated parts. A sleeve bearing, for example, may comprise a steel-backed bronze sleeve insertable into a crankcase, or a machined cylindrical surface made directly in the crankcase casting or another frame member.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the preferred embodiment, cylindrical bore 102 is defined by a steel backed bronze sleeve bearing press fit within slide block 100. A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 116 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 1, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gas refrigerant within each cylinder is discharged through discharge ports in a valve plate. With reference to cylinder 58 in FIG. 1, a cylinder head cover 134 is mounted to crankcase 46 with a valve plate 136 interposed therebetween. A valve plate gasket 138 is provided between valve plate 136 and crankcase 46. Valve plate 136 includes a coined recess 140 into which buttonhead 128 of threaded bolt 124 is received when piston assembly 98 is positioned at top dead center (TDC).

A discharge valve assembly 142 is situated on a top surface 144 of valve plate 136. Generally, compressed gas is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Referring once again to cylinder head cover 134, a discharge space 154 is defined by the space between top surface 144 of valve plate 136 and the underside of cylinder head cover 134. Cover 134 is mounted about its perimeter to crankcase 46 by a plurality of bolts 135, shown in FIG. 2. Discharge gas within discharge space 154 associated with each respective cylinder passes through a respective connecting passage 156, thereby providing communication between discharge space 154 and a top annular muffling chamber 158. Chamber 158 is defined by an annular channel 160 formed in top surface 66 of crankcase 46, and cage bearing 68. As illustrated, connecting passage 156 passes not only through crankcase 46, but also through holes in valve plate 136 and valve plate gasket 138.

Figure 3:
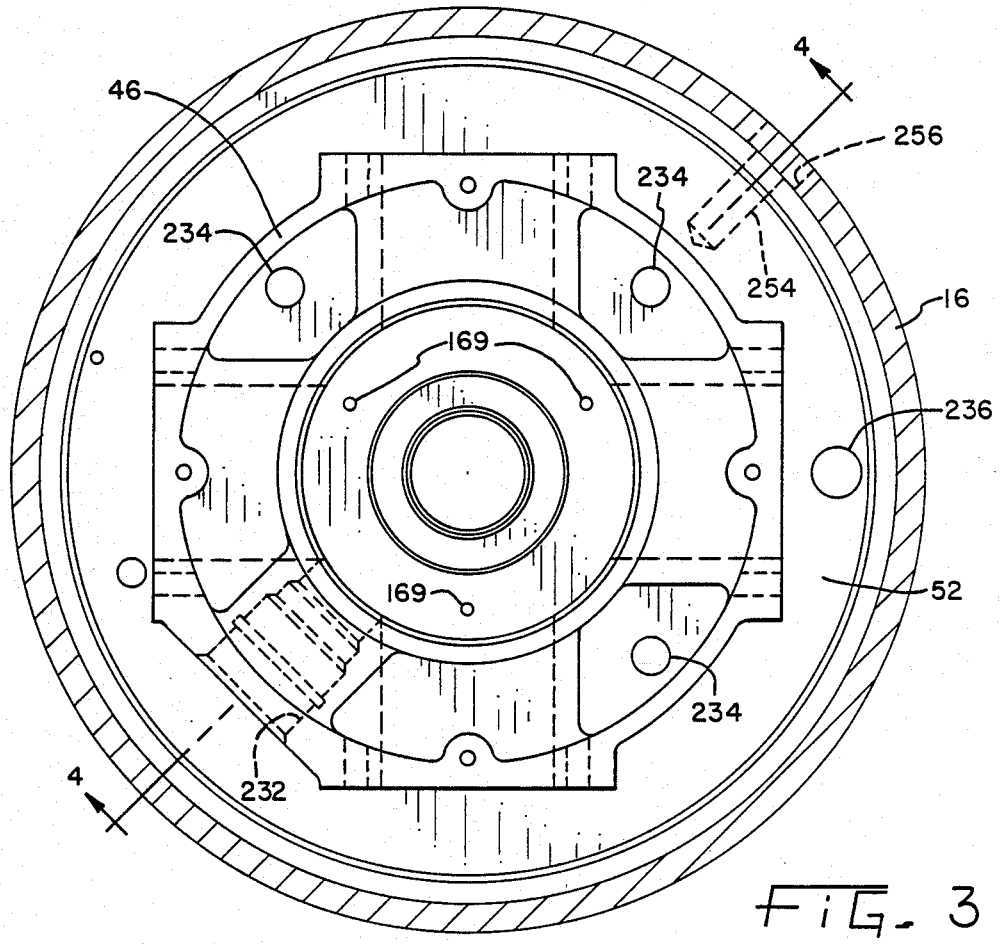
FIG. 3 is a top view of the crankcase of the compressor of FIG. 1, showing a sectional view of the housing taken along line 3—3 in FIG. 1 and viewed in the direction of the arrows.

Top muffling chamber 158 communicates with a bottom muffling chamber 162 by means of passageways extending through crankcase 46. Chamber 162 is defined by an annular channel 164 and a muffler cover plate 166. Cover plate 166 is mounted against bottom surface 76 at a plurality of circumferentially spaced locations by bolts 168 and threaded holes 169 (FIG. 3). Bolts 168 may also take the form of large rivets or the like. A plurality of spacers 170, each associated with a respective bolt 168, space cover plate 166 from bottom surface 76 at the radially inward extreme of cover plate 166 to form an annular exhaust port 172. The radially outward extreme portion of cover plate 166 is biased in engagement with bottom surface 76 to prevent escape of discharge gas from within bottom muffling chamber 162 at this radially outward location.

Compressor assembly 10 of FIG. 1 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 1, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Figure 2:
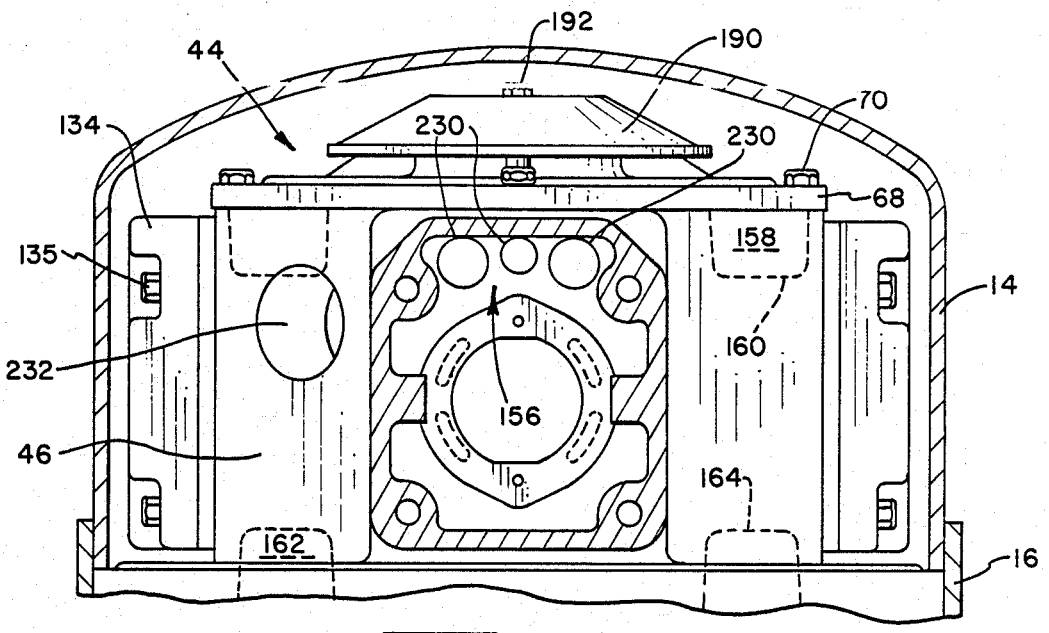
FIG. 2 is a fragmentary sectional view of the compressor of FIG. 1 taken along the line 2—2 in FIG. 1 and viewed in the direction of the arrows.

Referring now to FIG. 2, an upper portion of compressor mechanism 44 is shown to better illustrate the disclosed valve system and discharge muffling system. More specifically, FIG. 2 further shows connecting passage 156 of FIG. 1 as comprising a plurality of bores 230, associated with each radially disposed cylinder arrangement, to connect between discharge space 154 within cylinder head cover 134 and top muffling chamber 158. Also shown in FIG. 2 is a suction inlet opening 232 included in crankcase 46, providing communication between the outside of the crankcase and suction cavity 60 defined therein.

Figure 4:
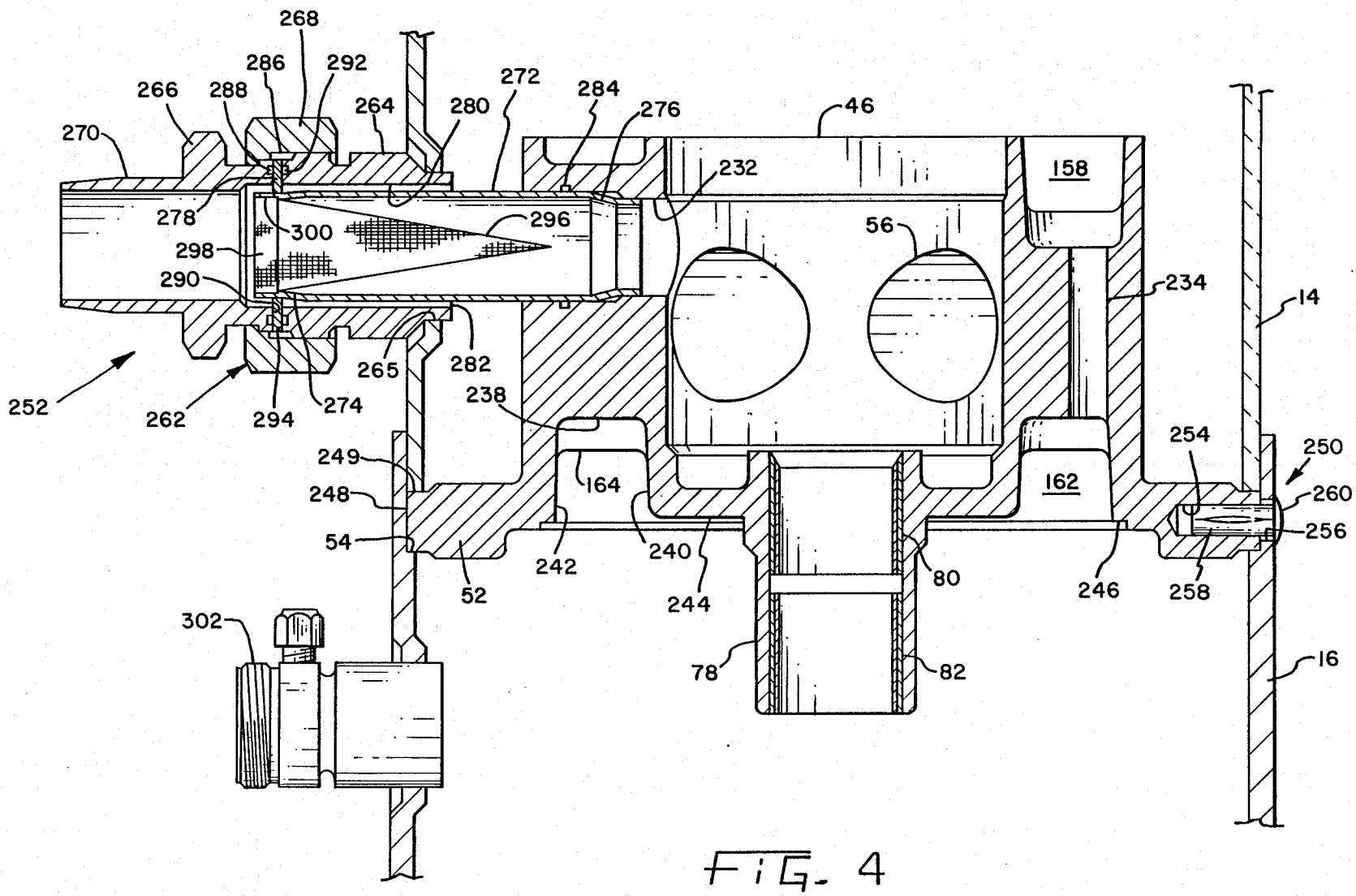
FIG. 4 is a fragmentary sectional view of the crankcase and housing assembly of FIG. 3 taken along the line 4—4 in FIG. 3 and viewed in the direction of the arrows, particularly showing a suction line adaptor and filter assembly in accordance with the present invention.

FIGS. 3 and 4 provide views of the crankcase showing three gas passageways 234 extending through crankcase 46 and providing communication between top muffling chamber 158 and bottom muffling chamber 162. In the preferred embodiment, the combined cross-sectional area of gas passageways 234 is made approximately equal to that of bores 230 associated with one cylinder to avoid pressure drops.

Referring now to FIG. 4, gas passageways 234 open into annular channel 164 comprising a bottom wall 238, a radially inner sidewall 240, and a radially outer sidewall 242. Bottom wall 238 extends to a greater depth between adjacent cylinders and is necessarily shallower at the location of each cylinder. It is also noted that annular channel 164 circumscribes bearing portion 78 in which crankshaft 32 is journalled.

Bottom surface 76 of crankcase 46 is provided with an inner annular ledge 244 and an outer annular ledge 246 comprising the adjacent top surfaces of inner sidewall 240 and outer sidewall 242, respectively. Referring to the combination of FIGS. 1 and 4, cover plate 166 is fixedly attached to inner ledge 244 by means of three bolts 168 engaging crankcase 46 in threaded holes 169. The radially outermost portion of cover plate 166 is biased in engagement with outer ledge 246. Two exemplary methods of effecting such a biased condition are as follows. First, where cover plate 166 is substantially flat, inner ledge 244 may be in a recessed, parallel offset plane with respect to outer ledge 246. The degree to which inner ledge 244 is recessed depends upon the thickness of spacers 170 and the amount of force necessary at the outermost portion of cover plate 166 to prevent rattling of the cover plate against outer ledge 246. Second, the outermost portion of cover plate 166 may be maintained in biased engagement against outer ledge 246 by making cover plate 166 dish-shaped, such as a bellville washer. In this arrangement, inner ledge 244 and outer ledge 246 may be substantially coplanar.

Specific reference will now be made to FIGS. 3 and 4 for a more detailed description of a mounting pin assembly 250 for preventing rotational movement of crankcase 46 within housing 12. Mounting flange 52 is axially supported within annular ledge 54. The outside diameter of flange 52 is spaced slightly, i.e., 0.005–0.010 inches, from central portion 16 at annulus 248 to prevent binding when expansion and contraction of the housing occurs due to pressure and temperature conditions. Also, there is planar contact between top portion 14 and flange 52 at 249, or perhaps a few thousandths of an inch clearance. Preferably, a clamping force at 249 is avoided so as to reduce stresses and associated noise.

A single mounting pin assembly 250 is provided diametrically opposed 180° from a suction fitting assembly 252. Mounting pin assembly 250 comprises a radially outwardly opening hole 254 in flange 52. An aperture 256 in substantial alignment with hole 254 is provided in central portion 16 of the housing. A notched pin 258 is frictionally engaged within hole 254 and extends into aperture 256. A weld is made between pin 258 and central portion 16 at aperture 256, represented in FIG. 4 by weldment 260.

Referring now to suction fitting assembly 252 in accord with the present invention, there is provided a housing fitting assembly 262 comprising a housing fitting member 264, a removable outer fitting member 266, and a threaded nut 268. Housing fitting member 264 is received within an aperture 265 in top portion 14 of the housing, and is sealingly attached thereto as by welding, brazing, soldering, or the like. Outer member 266 includes a steel nipple 270 into which suction tubing of a refrigeration system may be received and brazed or soldered thereto. Threaded nut 268 is rotatable, yet axially retained, on outer fitting member 266. Housing fitting member 264 is a slightly modified version of a fitting commercially available from Primor of Adrian, MI.

Suction fitting assembly 252 further includes a suction tube insert 272 comprising a short length of spun or swedged cylindrical tubing having a first end 274 and a second end 276. A ringlike flange 278, such as a stamped steel washer, is secured to the outside diameter of end 274 and extends radially outwardly therefrom. Flange 278 is secured to end 274 by means of brazing, soldering, clinching or welding. Housing fitting assembly 262, and particularly housing member 264 and outer member 266, includes a fitting bore 280 in which suction tube insert 272 axially resides. More specifically, the diameter of insert 272 is less than the diameter of bore 280 such that an annular clearance 282 is provided therebetween. In the preferred embodiment, clearance 282 is 0.050 inches circumferentially about insert 272.

During the design and manufacture of the compressor of the disclosed embodiment, it is anticipated that suction inlet opening 232 and fitting bore 280 will be axially aligned to permit extension of suction tube insert 272 therebetween. Specifically, second end 276 of insert 272 is sealingly slidably engaged within opening 232, as by a slip fit. An annular seal 284 is provided in the sidewall of opening 232 so that tube insert 272 may be inserted a selective depth into opening 232 while maintaining a proper seal. In this way, variations in radial spacing between crankcase 46 and central portion 14 of the housing may be compensated for.

With respect to rotational alignment of crankcase 46 such that tube insert 272 is axially received within fitting bore 280, mounting pin assembly 250 provides for a limited degree of rotational alignment. Compensation for misalignment between suction inlet opening 232 and fitting bore 280 along the axial direction with respect to compressor housing 12 is provided by the disclosed structure whereby flange 278 is retained within fitting bore 280. Flange 278 extends radially outwardly from insert 272 and is received between outer fitting member 266 and housing fitting member 264. Furthermore, an annular space 286 is provided between the outside diameter of flange 278 and the inside diameter of threaded nut 268. The combination of annular space 286 and annular clearance 282 permits random movement of tube insert 272 within bore 280, whereby the axis of insert tube 272 is substantially parallel to and selectively spaced relative to the axis of fitting bore 280. This freedom of motion of tube insert 272 within fitting bore 280 translates to approximately 0.100 inches of compensation for misalignment of suction inlet opening 232 and fitting bore 280 along the vertical axis of the housing.

The present invention further comprises a sealing arrangement whereby flange 278 is sealingly retained between housing fitting member 264 and outer fitting member 266. Specifically, an annular sealing ring 288 is interposed between sealing surface 290 of outer member 266, and flange 278. Likewise, an annular sealing ring 292 is interposed between a sealing surface 294 of housing member 264, and flange 278. Sealing rings 288, 292 may be composed of a rubber material such as neoprene or viton. In the preferred embodiment, annular sealing rings 288, 292 are retained within grooves in sealing surfaces 290, 294, respectively. Accordingly, flange 278 is sealingly secured between housing fitting member 264 and outer fitting member 266 when threaded nut 268 draws the two members together.

The suction fitting assembly of the present invention further comprises a conical screen filter 296 including a mounting ring 298 at the base end thereof. Mounting ring 298 slip fits into a counterbore 300 provided in first end 274 of suction tube insert 272. In such an arrangement, filter 296 may be easily removed for cleaning or replacement.

FIG. 4 also shows a discharge fitting 302 provided in central portion 16 of housing 12 located directly beneath suction fitting assembly 252. The location of discharge fitting 302 in a central or lower portion of the housing provides an advantage in that the fitting acts as a dam and limits to about 20 lbs. the amount of refrigerant charge that will be retained by the compressor and required to be pumped out upon startup.

It will be appreciated that the foregoing is presented by way of illustration only, and not by way of any limitation, and that various alternatives and modifications may be made to the illustrated embodiment without departing from the spirit and scope of the invention.

What is claimed is:

1. A compressor assembly, comprising:

a hermetically sealed housing having a sidewall;

means supported within said housing for compressing gas refrigerant including a compressor mechanism having a crankcase, said crankcase having a suction cavity disposed therein and a suction inlet opening providing communication between said suction cavity and the outside of said crankcase, said suction inlet opening extending radially outwardly from said suction cavity along an axis substantially perpendicular to said sidewall;

a suction fitting mounted in said sidewall, said fitting including a substantially cylindrical fitting bore extending therethrough along a bore axis substantially perpendicular to said sidewall, said fitting bore and said suction inlet opening being generally aligned;

a suction tube insert having a first axial end received within said fitting bore and having a second end sealingly received within said suction inlet opening; and means for retaining said suction tube insert within said fitting bore in a selected position such that the axis of said first end is maintained substantially parallel to and selectively spaced relative to said bore axis, said retaining means comprising a radially extending flange, said flange being sealingly engaged at an outer peripheral portion thereof with said fitting bore, whereby initial misalignment between said fitting bore and said suction inlet opening during compressor assembly is compensated for.

2. The compressor assembly of claim 1 in which:

said suction fitting comprises a removable outer fitting member and a housing fitting member, said outer fitting member being threadedly attached to said housing fitting member with a portion of said flange being interposed therebetween.

3. The compressor assembly of claim 2, and further comprising:

a pair of annular seals, one of said pair of seals being interposed between said flange and said outer fitting member, and the other of said pair of seals being interposed between said flange and said housing fitting member.

4. The compressor assembly of claim 1, and further comprising filter means disposed within said tube insert.

5. The compressor assembly of claim 1 in which said crankcase is spaced radially inwardly from said sidewall.

6. The compressor assembly of claim 1 in which:

said second end is received within said suction inlet opening by means of a slip fit, one of said suction inlet opening and said second end including an annular groove formed therein into which a seal element is provided to sealingly engage said second end within said inlet opening.

7. In a compressor assembly comprising a compressor mechanism supported within a hermetically sealed housing having a sidewall, said compressor mechanism including a crankcase having therein a suction cavity and a suction inlet opening providing communication between said cavity and the outside of said crankcase, said suction inlet opening extending radially outwardly from said cavity along a radial axis substantially perpendicular to said sidewall, a suction fitting assembly for providing communication between said suction inlet opening and the outside of said housing, comprising:

a fitting member mounted to said sidewall and including a bore extending therethrough generally along said radial axis, said fitting member including an annular groove in communication with said bore and extending radially outwardly therefrom with respect to said radial axis; and an elongated tubular insert member having a diameter smaller than the diameter of said bore, said insert member including a washer-shaped flange circumferentially attached to the outside wall of said tubular insert member and extending radially outwardly therefrom, the outermost diameter of said flange being less than the outermost diameter of said annular groove, one end of said insert member being slidably received within said suction inlet opening and the other end being received within said bore, said flange being received within said annular groove, whereby said tubular insert member is selectively positioned within said bore to compensate for axial misalignment between said suction inlet aperture and said bore.

8. The suction fitting assembly of claim 7 in which:

said fitting member comprises a removable threaded outer portion and a threaded housing portion, said outer portion being mounted to said housing portion by means of a threaded nut bridging a space between said outer portion and said housing portion at respective outer diameters thereof, said space defining said annular groove, the outermost diameter of said flange being less than the inside diameter of said nut.

9. The compressor assembly of claim 8, and further comprising:

a conical screen filter including a mounting ring located at the base end of said conical filter, said mounting ring being received within a counterbore formed in said tube insert at said one end thereof.

10. A compressor assembly, comprising:

a hermetically sealed housing including a vertical cylindrical sidewall;

a compressor mechanism for compressing gas refrigerant including a crankcase having a mounting flange portion, said crankcase including therein a suction cavity and a suction inlet opening providing communication between said cavity and the outside of said crankcase, said suction inlet opening extending radially outwardly from said cavity along a radial axis substantially perpendicular to said sidewall;

means associated with said sidewall for axially supporting said compressor mechanism, said means including an annular ledge on which said flange portion rests;

means for preventing rotational movement of said crankcase about the vertical axis of said housing, said preventing means comprising a pin member received within a hole defined by said crankcase and extending through an aperture in said sidewall, said pin member being welded to said housing at the location of said aperture;

a suction fitting mounted in said sidewaqll, said fitting including a substantially cylindrical fitting bore extending therethrough along a bore axis substantially perpendicular to said sidewall, said suction inlet opening and said fitting bore being generally aligned;

a suction tube insert having a first axial end received within said fitting bore and having a second end slidably sealingly received within said suction inlet opening; and means for retaining said suction tube insert within said fitting bore in a selected position such that the axis of said first end is maintained substantially parallel to sand selectively spaced relative to said bore axis, said retaining means comprising a radially extending flange, said flange being sealingly engaged at an outer peripheral portion thereof said fitting bore, whereby initial misalignment between said fitting bore and said suction inlet opening during compressor assembly is compensated for.

11. The compressor assembly of claim 10 in which:

said suction fitting comprises a removable outer fitting member and a housing fitting member, said outer fitting member being threadedly attached to said housing fitting member with a portion of said flange being interposed therebetween.

12. The compressor assembly of claim 11, and further comprising:

a pair of annular seals, one of said pair of seals being interposed between said flange and said outer fitting member, and the other of said pair of seals being interposed between said flange and said housing fitting member.

13. The compressor assembly of claim 10, and further comprising filter means disposed within said tube insert.

14. The compressor assembly of claim 10 in which said crankcase is spaced radially inwardly from said sidewall.

15. The compressor assembly of claim 10 in which:

said second end is received within said suction inlet opening by means of a slip fit, one of said suction inlet opening and said second end including an annular groove formed therein into which a seal element is provided to sealingly engage said second end within said inlet opening.

* * * * *